US006440272B1

(12) United States Patent
Binder et al.

(10) Patent No.: US 6,440,272 B1
(45) Date of Patent: Aug. 27, 2002

(54) DEVICE FOR MIXING STOCK SUSPENSIONS

(75) Inventors: Erwin Binder; Karl-Heinz Beuermann, both of Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 24 days.

(21) Appl. No.: 09/609,636

(22) Filed: Jul. 3, 2000

Related U.S. Application Data

(62) Division of application No. 09/340,433, filed on Jun. 28, 1999, now Pat. No. 6,200,417.

(30) Foreign Application Priority Data

Jun. 29, 1998 (DE) ..... 198 28 998
Dec. 23, 1998 (DE) ..... 198 59 770

(51) Int. Cl.[7] ..... D21D 1/00

(52) U.S. Cl. ..... 162/261; 162/343; 162/344; 162/190; 162/264; 162/57; 73/63; 366/307; 366/175.2; 8/156

(58) Field of Search ..... 162/261, 343, 162/344, 190, 264, 57, 56, 23, 28, 52; 73/63; 366/307, 175.2; 8/156

(56) References Cited

U.S. PATENT DOCUMENTS

| | | | |
|---|---|---|---|
| 1,670,874 | A | 5/1928 | Bankus |
| 4,477,313 | A | 10/1984 | Andersson |
| 5,707,495 | A | 1/1998 | Heinzmann et al. |

FOREIGN PATENT DOCUMENTS

| | | |
|---|---|---|
| DE | 1561697 | 10/1970 |
| DE | 3244142 | 6/1983 |
| DE | 4125513 | 2/1993 |
| DE | 4239647 | 11/1994 |
| DE | 19509522 | 9/1996 |

OTHER PUBLICATIONS

Begemann, "Module Jet—erste Betriebserfahrungen mit dem neuen Stoffauflaufkonzept," *Wochenblatt für Papierfabrikation*, No. 12, pp. 485–491 (1994).

Lehleiter, "Combiflow und Stoffmischer im Stoffzufuhrsystem für bessere Längsprofile," *Wochbenblatt für Papierfabrikation*, No. 7, pp. 246–250 (1992).

Melzer, "Computersimulation der Hilfsmittelverteilung in Stoffleitungen," *Wochenblatt für Papierfabrikation*, No. 15, pp. 609–616 (1993).

*Primary Examiner*—Stanley S. Silverman
*Assistant Examiner*—Mark Halpern
(74) *Attorney, Agent, or Firm*—Greenblum & Bernstein, P.L.C.

(57) ABSTRACT

Process and device for the mixing of suspensions with possibly different natures and/or compositions in the stable section of a paper machine. In the process, a suspension, particularly of the backwater of the paper machine, is piped in a mixing tube with the main flow direction in the longitudinal direction of the tube, and additional suspensions, with possibly different solid content, are injected. In the device, a mixing device and piping carry the suspension in the stable section of a paper or cardboard machine and blend suspensions with a higher solid content into a first suspension with little or no solid content. The mixing device and piping include a tube, at least one inlet for the first suspension, a plurality of feeds for the higher solid content suspensions to be admixed, and one outlet for the blended suspension, with a new solid content, arranged downstream from a bend in the tube. The mixing tube extends over a plane including sections of the tube upstream and downstream of the bend, and the impeller axis of a downstream pump is perpendicular to this plane.

17 Claims, 7 Drawing Sheets

DEVICE FOR MIXING STOCK SUSPENSIONS

CROSS-REFERENCE TO RELATED APPLICATIONS

The present application claims priority under 35 U.S.C. § 119 of German Patent Application No. 198 28 998.7, filed on Jun 29, 1998, and German Patent Application No. 198 59 770.3, filed on Dec. 23, 1998, the disclosures of which are expressly incorporated by reference herein in their entireties. This application is a division of U.S. patent application Ser. No. 09/340,433, filed Jun. 28, 1999, which issued on Mar. 13, 2001 as U.S. Pat. No. 6,200,417, the contents of which are expressly incorporated by reference in their entirety.

BACKGROUND OF THE INVENTION

1. Field of the Invention

The invention relates to a process and a device for mixing and piping suspensions of different natures and/or compositions in the stable section of a paper machine.

2. Description of Background Information

A process and device for mixing suspensions is known from U.S. Pat. No. 4,477,313 to Andersson, issued Oct. 16, 1984. According to the Andersson patent, the backwater collected in the paper machine is passed into open backwater tanks, and is then fed back to the headbox via mixing pumps provided with a thick stock supply.

If a change in paper type is made on the paper machine, drainage conditions usually change and, thus, the concentration (e.g., solid content) of the backwater (in particular) usually changes. However, in the Andersson patent, due to the high residence time of the backwater in the backwater tank, the concentration in the backwater tank changes only slowly. This means that stable conditions are established very slowly in the backwater cycle. During this adjustment phase, production must often be slowed down to achieve the required paper quality. Consequently, production and quality losses occur.

Another process and device for mixing suspensions is known from the (Published) German Patent Application No. DE 195 09 522 A1, published Sep. 26, 1996. In this document, a stock suspension is fed to a headbox, that is sectioned over the width of the machine, through a plurality of lines feeding stock suspension. The lines feeding stock suspension are connected to a distributor. A portion of the backwater arriving in the drainage region of the paper machine is fed sectionally to the headbox, and is used for basis weight control according to the well-known dilution principle. The remainder of the backwater is passed into a backwater tank, and sent back from the backwater tank into the stock preparation system ("stable section"), although the stable section is not shown in DE 195 09 522 A1.

SUMMARY OF THE INVENTION

In view of the shortcomings of the prior art, an object of the invention is to provide a process for the mixing of suspensions of different nature and/or composition in the stable section of a paper machine, which provides an improvement in the quality as well as a reduction in production loss at the time of the changeover between types. It should be noted that in the context of the specification and claims, suspensions having different "characteristics" have differing natures and/or compositions.

A further object of the invention is to provide a mixing device and/or piping in the stable section of a paper or cardboard machine for the blending of suspensions with higher solid content into a first suspension with little or no solid content, which likewise effects a reduction in quality losses and production loss at the time of the changeover between types. It should be noted that in the context of the specification and claims, a "negligible" solid content means little or no solid content.

According to a first aspect of the present invention, a process for mixing suspensions having differing characteristics in the stable section of a paper machine includes piping of a first suspension in a mixing tube to form a main flow having a main flow direction in a longitudinal direction of the mixing tube, and injecting one or more additional suspensions into the mixing tube. The additional suspension (s) may have a different solid content than the first suspension.

By means of the process according to the invention, larger backwater tanks are avoided, thereby reducing the amount of water in circulation in the paper machine, and, thus, at the time of the type changeover in the paper machine, a more rapid change in the composition of the stock suspensions is possible. Based on this more rapid change, the quality losses, and therefore also the production losses, are reduced. The "backwater" indicates the total circulating backwater with which, along with the fresh stock, the concentration of the stock suspension required in the headbox is obtained, as depicted in FIG. 1. The cycles in the stable section are described in detail in the literature.

Optionally, a solid content of an additional suspension injected downstream along the main flow direction is, in each case, higher than or equal to a solid content of another additional suspension injected upstream along the main flow direction.

Further optionally, the first suspension includes a suspension of a backwater of the paper machine, and an entire backwater volume stream flows through the mixing tube. In this case, the backwater volume stream may be reduced by a backwater substream sufficient, according to the dilution water principle, for weight basis control on a headbox of the paper machine.

In a particularly advantageous embodiment of the process, flow directions of each of the injected additional suspensions coincide with the main flow direction.

Another embodiment of the process according to the invention includes maintaining a flow rate of the main flow in the mixing tube at a substantially constant level despite added liquid in the injected additional suspension, the flow rate of the main flow in the mixing tube increasing only in an end region of the mixing tube. For a rapid type changeover without losses with respect to paper quality, the residence time of the backwater in the system should be as short as possible. Consequently, the flow rate in the mixing tube is optionally greater than 0.2 m/s, and further optionally, greater than 0.45 m/s (e.g., the dimensions of the mixing device are arranged to maintain these numerical flow rates).

It is also advantageous if each additional suspension is injected concentrically in the main flow. If the recirculation from the headbox is not piped into the mixing tube, recirculation from a headbox may be passed via a line to a vertical separator second stage.

In one particular variation, the first suspension includes a backwater stream of the paper machine, and the injections of additional suspensions include, in order along the main flow, injection of recirculation from a headbox, followed by injection of accepted stock from a vertical separator second stage, followed by injection of recirculation of a first cleaner stage, followed by injection of accepted stock from a second cleaner stage, followed by injection of fresh stock. Although this sequencing of the insertions in the direction of flow is particularly advantageous, additional suspension streams may be injected between, before, or after the recited order, or the sequence may be adapted according to the concentration gradient in view of other conditions present, relative to the concentration of the suspension streams. Moreover, the language "followed by" is not intended to preclude preceding, intervening, or following process operations after any individual injection, group of injections, or all the injections—other process operations may be placed in such positions without departing from the spirit of the invention.

In another particular variation, the first suspension includes a backwater stream of the paper machine, and the injections of the additional suspensions include, in order along the main flow, injection of accepted stock from a vertical separator second stage, followed by injection of recirculation from a first cleaner stage, followed by injection of accepted stock from a second cleaner stage, followed by injection of fresh stock. With this variation, pulsations originating from the headbox and changes in recirculation do not affect the stability of the stable section of the paper machine.

In still another variation, the first suspension includes a backwater stream of the paper machine, and the injections of the additional suspensions include, in order along the main flow, injection of accepted stock from a vertical separator second stage, followed by injection of accepted stock of a second cleaner stage, followed by injection of excess from a stock suspension feed to a headbox, followed by injection of fresh stock.

In yet another variation, the process further includes feeding a first backwater fraction of a backwater stream of the paper machine as the first suspension into a first mixing tube, and feeding a second backwater fraction of a backwater steam of the paper machine as the first suspension into a second mixing tube. In the first mixing tube, the injections of the additional suspensions include, in order along the main flow, injection of accepted stock from a vertical separator second stage, followed by injection of accepted stock of a second cleaner stage, followed by injection of fresh stock. In the second mixing tube, the injections of the additional suspensions include injection of accepted stock from a first cleaner stage.

If there is a steamer on the headbox a return flow from the steamer may be passed via a feed line to a vertical separator second stage.

Another advantageous embodiment of the process provides that the additional suspension(s) is added via a nozzle surrounded by the main flow. The flow rate vD in the nozzle and a flow rate vU of the main flow in a region surrounding the nozzle vU are in a ratio vD/vU from 3 to 15. Maintaining this relationship particularly favors a thorough mixing of the individual liquids.

In still another advantageous embodiment, a region of mixing, i.e., in the region of the addition of the suspensions with higher solid content, between the first suspension and the additional suspension(s) is a hydraulically closed system, preventing equalization of pressure with the surrounding areas. Thus, advantageously, the entire hydraulic system between the paper machine and the stock stream of the headbox can have a closed construction. In other words, there are no free surfaces of the suspension exposed to surrounding areas.

In another variation, a plurality of additional suspensions are injected into the main flow, and volume flow increases downstream along the main flow. The volume flow of the last injection added is smaller than the volume flow of the next to last injection added. Alternatively, the volume flow of the next to last injection added is greater than the volume flow of the last injection added.

In a modification, the injection of the additional suspension(s) includes wherein the injection of additional suspension(s) includes injection of a plurality of ingredients of fresh stock via a plurality of corresponding feeds in substantially the same location along the main flow.

According to another aspect of the present invention, a mixing device for the blending of additional suspensions into a first suspension in the stable section of a paper machine includes a tube, and an intake in the tube for the first suspension, the first suspension having a negligible solid content. A plurality of feeds into the tube are provided for the additional suspensions to be blended with the first suspension into a blended suspension with a new solid content, the additional suspensions having higher solid content than the first suspension. An outlet in the tube is provided for the blended suspension, the outlet being disposed downstream from a bend in the tube. A pump is connected to the tube downstream from the outlet, wherein an impeller axis of the pump is perpendicular to a plane containing portions of the tube both upstream and downstream of the bend. That is, the mixing device is preferably arranged perpendicularly and has at its lower end a bend with a connection to the downstream pump (e.g., the cleaner pump). The plane of the bend and the perpendicular part of the mixing tube is perpendicular to the axis of rotation of the downstream pump. This ensures uniform inflow, in particular with double-suction pumps. It should be noted that a "mixing device" can include a mixing device and associated piping.

Advantageously, each of the plurality of feeds includes an injection site that injects an additional suspension having a solid content equal to or greater than a previous injection site of a previous feed along the downstream direction of the main flow. In other words, the concentration or the solid content of the suspensions added should increase continuously or remain the same in the direction of flow. The concentration differences at the individual mixing points are minimized, which ensures high mixing efficiency and low fluctuations in concentration. In this case, each of the injection sites may include an outlet port with each outlet port pointing in a direction of the main flow. In this manner, the flow directions of the main flow and the added suspension(s) have essentially the same orientation.

Optionally, an internal diameter of the mixing device is designed such that a flow rate of the main flow is maintained at a substantially constant level despite added liquid in the additional suspensions blended therein, and such that the flow rate of the main flow in the mixing device increases only in an end region of the mixing device.

Each of the plurality of feeds may include an injection site, and each injection site may terminate centrally in the mixing device.

If the recirculation from the distributor of the headbox is not passed into the mixing device, a recirculation line from a distributor of a headbox may pass via a line to a vertical separator second stage. Moreover, a return flow line from a steamer of a headbox may be passed via a line to a vertical separator second stage.

In one particular variation, the feeds into the tube for the additional suspensions include, in order along the main flow, a feed for recirculation from a headbox, followed by a feed for accepted stock from a vertical separator second stage, followed by a feed for recirculation of a first cleaner stage, followed by a feed for accepted stock from a second cleaner stage, followed by a feed for fresh stock. As noted above, although is sequencing of the feeds in the direction of flow is particularly advantageous, additional feeds may be provided between, before, or after the recited order, or the sequence may be adapted according to the concentration gradient in view of other conditions present, relative to the concentration of the suspension streams. Moreover, the language "followed by" is not intended to preclude preceding, intervening, or following structure after any individual feed, group of feeds, or all the feeds—other structure may be placed in such positions without departing from the spirit of the invention.

In another particular variation, the feeds into the tube for the additional suspensions include, in order along the main flow, a feed for accepted stock from a vertical separator second stage, followed by a feed for recirculation from a first cleaner stage, followed by a feed for accepted stock from a second cleaner stage, followed by a feed for fresh stock. In this manner, addition of the recirculation from the headbox is eliminated, avoiding possible pressure fluctuations and pulsations in the stable section which could be transferred by the recirculation from the headbox.

In still another particular variation, the feeds into the tube for the additional suspensions include, in order along the main flow, a feed for accepted stock from a vertical separator second stage, followed by a feed for accepted stock of a second cleaner stage, followed by a feed for excess from a stock suspension feed to a headbox, followed by a feed for fresh stock.

In yet another particular variation, the tube includes a first mixing tube provided for a first backwater fraction of a backwater stream of the paper machine, and a second mixing tube for a second backwater fraction of a backwater stream of the paper machine. The feeds into the first mixing tube for the additional suspensions include, in order along the main flow, a feed for accepted stock from a vertical separator second stage, followed by a feed for accepted stock of a second cleaner stage, followed by a feed for fresh stock. The feeds into the second mixing tube for the additional suspensions include a feed for accepted stock from a first cleaner stage.

Optionally, each of the plurality of feeds includes an injection site surrounded by the main flow, and inside diameters of the injection sites and an inside diameter of the mixing device in the region of the injection site are arranged such that a flow rate vD in each injection site and a flow rate vU of the main flow in a region surrounding the injection site are in a ratio vD/vU from 3 to 15. As noted above, maintaining this relationship particularly favors a thorough mixing of the individual liquids.

Further optionally, the mixing device is a hydraulically closed system excepting the intake and the outlet port for the blended suspension. That is, the mixing device is closed relative to its surroundings, or constitutes a closed hydraulic system having no pressure equalization capability with its surroundings. As noted above, the entire hydraulic system between the paper machine and the stock stream of the headbox can have a closed construction, and there are no free surfaces of the suspension exposed to surrounding areas.

According to still another aspect of the present invention, a mixing device for the blending of additional suspensions into a first suspension in the stable section of a paper machine includes a tube, and an intake in the tube for the first suspension, the first suspension having a negligible solid content. A plurality of feeds into the tube are provided for the additional suspensions to be blended with the first suspension into a blended suspension with a new solid content, the additional suspensions having higher solid content than the first suspension. An outlet in the tube is provided for the blended suspension, the outlet being disposed downstream from a bend in the tube. Each feed of the plurality of feeds injects an additional suspension having a solid content equal to or greater than a previous feed along the dowstream direction of the main flow.

According to yet another aspect of the invention, a process for mixing suspensions having differing solid content in the stable section of a paper machine, includes feeding a backwater suspension from a wet section of the paper machine as a main flow into a closed vertical mixing tube, then injecting accepted stock from a vertical separator system concentrically into the main flow to form a blended suspension in the mixing tube, the injection of the accepted stock having a higher solid content than the backwater suspension and a higher flow rate than the main flow. Fresh stock is then injected concentrically into the blended suspension in the mixing tube, the injection of the fresh stock having a higher solid content than the blended suspension and a higher flow rate than the blended suspension, then the blended suspension is pumped from the mixing tube.

In this case, a flow rate in the mixing tube may be maintained at a substantially constant level upstream and downstream of the injections.

According to still yet another aspect of the invention, a mixing device for the blending of additional suspensions into a backwater suspension in the stable section of a paper machine includes a closed vertical mixing tube having a bend at a lower end thereof. An intake is provided at a top of the tube for a backwater suspension from a wet section of the paper machine, the backwater suspension forming a main flow. A first concentric nozzle injects accepted stock, having a higher solid content than the backwater suspension, from a vertical separator system into the mixing tube to form a blended suspension. The first concentric nozzle is concentric to the mixing tube and upstream of the bend, and injects the accepted stock at a higher flow rate than the main flow. A second concentric nozzle injects fresh stock having a higher solid content than the blended suspension into the mixing tube. The second concentric nozzle is concentric to the mixing tube and downstream of the bend, and injects the fresh stock at a higher flow rate than the blended suspension. An outlet in the tube is disposed downstream from the bend and from the second concentric nozzle.

In his case, a diameter of the mixing tube may increase in the direction of the main flow to maintain a flow rate in the mixing tube at a substantially constant level upstream and downstream of both of the first concentric nozzle and the second concentric nozzle.

Accordingly, with the invention as described, it is possible to omit the expensive backwater tanks and, if necessary, to form a closed hydraulic system. This results in shorter residence times of the suspension return flow and a more rapid stabilization of the hydraulic system with regard to concentration and suspension composition after a type changeover. Thus, reduced production loss and fewer quality losses are achieved.

BRIEF DESCRIPTION OF THE DRAWINGS

The present invention is further described in the detailed description which follows, in reference to drawings by way of non-limiting examples of exemplary embodiments of the present invention, in which like reference numerals represent similar parts throughout the drawings, and wherein.

DETAILED DESCRIPTION OF THE INVENTION

The particulars shown herein are by way of example and for purposes of illustrative discussion of the embodiments of the present invention only, and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
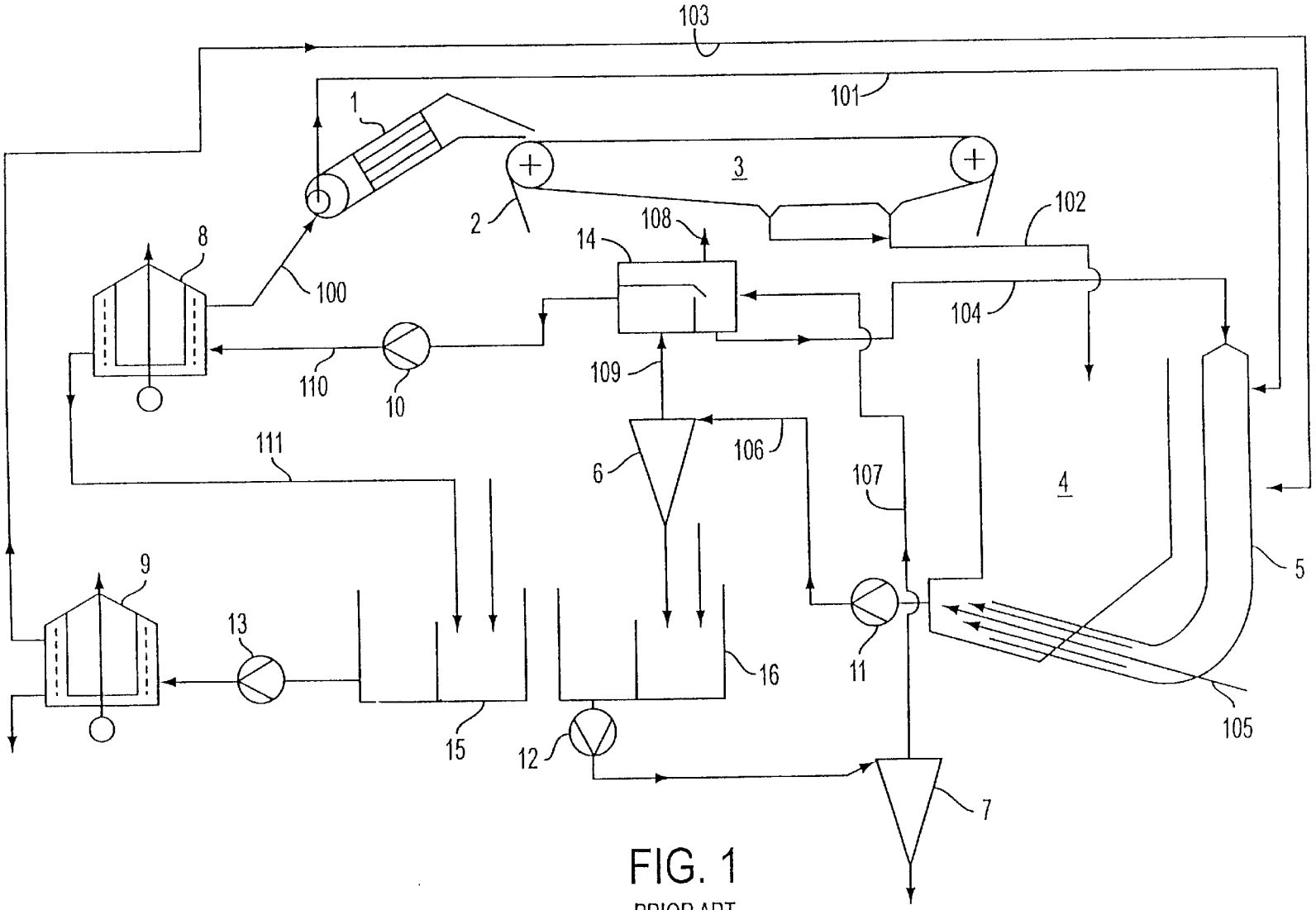
FIG. 1 PRIOR ART
FIG. 1 shows a schematic depiction of a detail of a paper machine with the stable section, the beginning of the wet section including the headbox according to the prior art.

FIG. 1 depicts a schematic detail of a known paper machine with the stable section and the being of the wet section of the paper machine including the headbox on a Fourdrinier paper machine. It should be noted that a "paper machine" is inclusive of at least paper and cardboard machines. A stock suspension is fed to a headbox 1 via a line 100, distributed in the headbox over the width of the machine, and applied to a wire 2. Then, along drainage devices 3 beneath the wire 2, the backwater penetrating the wire 2 is fed via lines 102 into an open backwater tank 4. A mixing tube 5 is provided near the backwater tank 4, and the overflow of a deaeration tank 14 is fed as the main flow via the line 104 into the mixing tube 5.

The overflow of a distribution pipe of the headbox 1 is injected, via a line 101, into the mixing tube 5. Accepted stock from a vertical separator second stage 9 is fed into the mixing tube 5 via the line 103. The mixing tube 5 is introduced into the output of the (open) backwater tank 4. A further addition of fresh stock is made via the line 105 after the bend in the mixing tube 105.

A first cleaner pump 11 delivers the stock suspension from the mixing tube 5 via the line 106 to a first cleaner stage 6. From the first cleaner stage 6, the stock suspension arrives, via a mixing tank 16 and conveyed by a second cleaner pump 12, to a second cleaner stage 7. The stock suspension is pumped via a line 107 to the deaeration tank 14. The deaeration tank 14 is connected to a suction line 108 to degas the stock suspension.

In addition, stock suspension from the first cleaner stage 6 is also fed into the deaeration tank 14 via a line 109. From the deaeration tank 14, the stock suspension arrives via a line 110, and conveyed by a headbox pump 10, to a vertical separator first stage 8. The stock suspension flows from the vertical separator first stage 8, via a line 100, to the distribution pipe of the headbox 1. A coarser fraction of the vertical separator first stage 8 is again fed via an open-tank intermediate station 15 and line 111, to the vertical separator second stage 9, in which separation again takes place. In this manner, the finer fraction is passed back via the line 103 (as noted above) into the mixing tube 5, while the coarse fraction is discharged from the vertical separator second stage 9.

Figure 2:
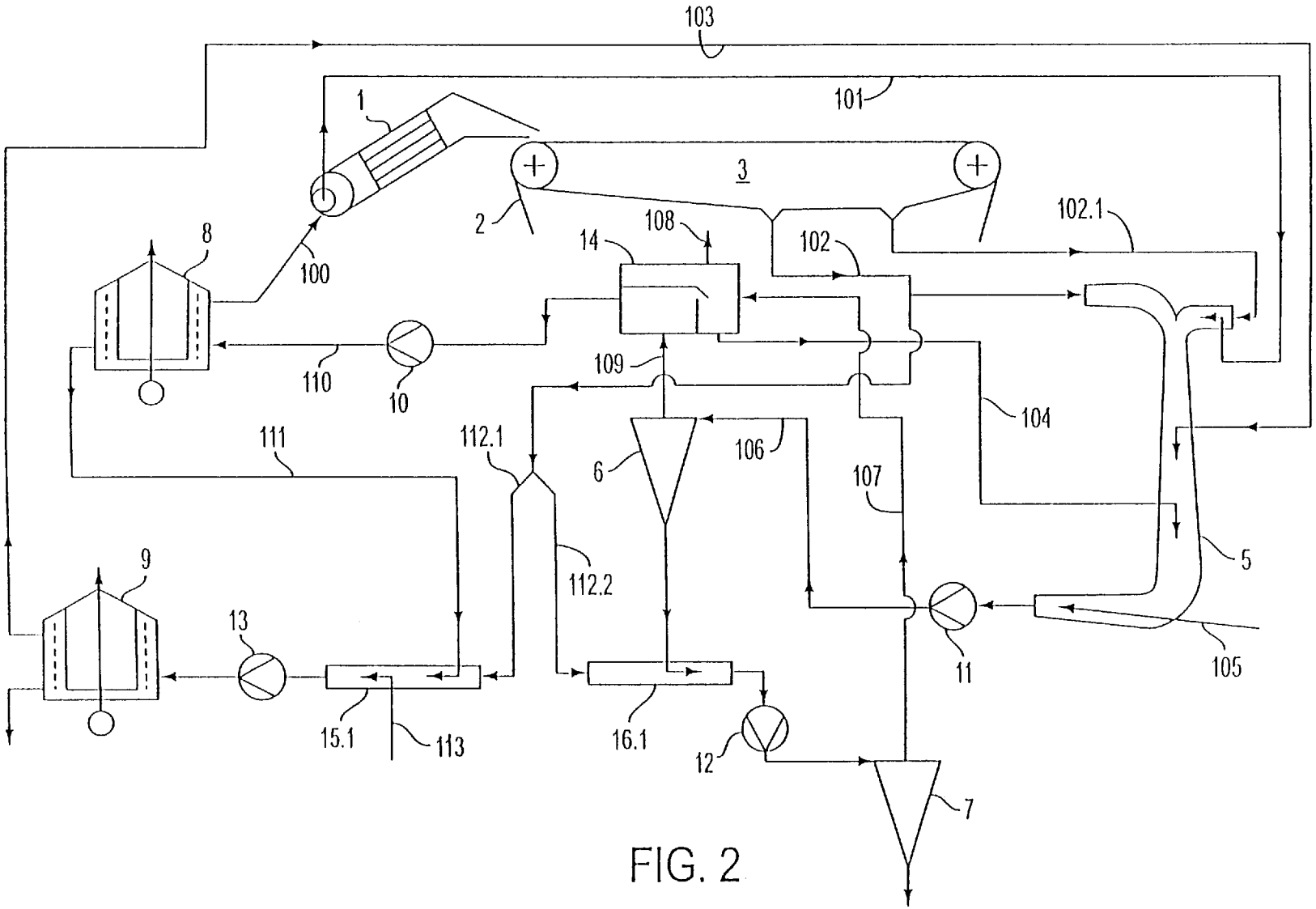
FIG. 2 shows a schematic depiction of a detail of a paper machine of the general type depicted in FIG. 1, but with a mixing tube according to an embodiment of the invention.

FIG. 2 depicts, in schematic detail, the invention as applied to the stable section of a paper machine. FIG. 2 also shows the beginning of the wet section of a paper machine, including a headbox 1. By way of example, a Fourdrinier paper machine is depicted here; however, the invention can also be used on hybrid formers and gap formers. It should be noted that where a description of an element is omitted hereinafter, the structure and function of such elements substantially correspond to those described with reference to FIG. 1.

FIG. 2 shows how stock suspension is fed via the line 100 to the headbox 1. The headbox 1 delivers the stock suspension onto a wire 2 of the wet section 3, with a first backwater fraction collected and transported away via a line 102, and a second backwater fraction collected and transported away via a line 102.1. The first backwater fraction is split at two junctions or connecting branches, and is thereby distributed via the line 102 to a mixing tube 5, and also to two hydraulic mixers 15.1 and 16.1.

The first backwater fraction collected and transported via line 102 has, in general, the least solid content, and is therefore introduced as a first suspension into the mixing tube 5. The second backwater fraction is fed to the mixing tube 5 from the other side of the mixing tube 5 and downstream from the first backwater fraction. Moreover, a recirculation stream coming out of the distributor of the headbox 1 is introduced via a line 101 into the backwater stream of the second backwater fraction. Overall, this combination of backwater and recirculation streams yields a mixture relationship of the stock suspensions in which, in each case, a higher stock suspension concentration (e.g., solid content) is introduced into a stock suspension having the same or a lower concentration.

As the stock suspension proceeds through the mixing tube 5, a stock suspension from the vertical separator second stage 9 is introduced via the line 103. The accepted stock of the first cleaner stage 6 is fed via the line 109 directly to the deaeration tank 14, and the accepted stock from the second cleaner stage is also fed, via the line 107, into the deaeration tank 14. The excess from the deaeration tank 14 is introduced from the deaeration tank 14 into the mixing tube 5 via the line 104, in this embodiment downstream of the line 103. It should be noted that it is possible to add additional accepted stocks from additional cleaner stages, although such is not explicitly depicted in FIG. 2.

Finally, in the end region of the mixing tube 5, fresh stock is injected via the feed line 105, is mixed with the entire recirculating suspension, and is passed to the pump 11. From the pump 11, a line 106 leads to the first cleaner stage 6. As noted above, the accepted stock of the first cleaner stage 6 is delivered via the line 109 to the deaeration tank 14. The remainder of the stock suspension is passed from the first cleaner stage 6 to the hydraulic mixer 16.1.

An advantageous structural arrangement in this process diagram, with regard to the mixing tube 5, is that each feed line (e.g., 102, 102.1, 101, 103, and 104) is disposed such that, in each case, an equally concentrated or more concentrated stock suspension flow is introduced into a less concentrated stock suspension flow. It should be noted that, depending on the conditions of the system, with different concentration relationships, the sequence of introduction of the feeds may be changed, such that this condition for the concentrations of the stock suspension added remains the same, i.e., equally concentrated or more concentrated stock suspension flows are introduced into a less concentrated stock suspension flow.

Another advantageous characteristic of the process diagram depicted in FIG. 2 consists in the closed hydraulic cycle, i.e., the elimination of the open storage tanks 15 and 16 depicted in FIG. 1. The open tanks 15 and 16, according to the invention, are replaced with closed hydraulic mixers 15.1 and 16.1.

In the hydraulic mixer 16.1 of the process diagram of FIG. 2, a portion of the first backwater fraction is fed via the line 102 to the line 112.2. This portion of the first backwater fraction is then mixed in the hydraulic mixer 16.1 with the excess of the suspension from the first cleaner stage 6. The suspension is fed from the hydraulic mixer 16.1 via a pump 12 to the second cleaner stage 7. The accepted stock of the second cleaner stage 7, as noted above, is passed via the line 107 into the deaeration tank 14.

The second hydraulic mixer 15.1 is also fed, via the line 112.1, with a portion of the first backwater fraction from the line 102. The coarse fraction of the vertical separator first stage 8 is fed into the hydraulic mixer 15.1 via the line 111. It should be noted that the second hydraulic mixer can mix accepted stock passed from a vertical separator third stage 9.1 via the line 113, but it is not necessary that the vertical separator third stage 9.1 be used. It should also be noted that the arrangement of the vertical separator third stage 9.1, although shown only in FIG. 2*a,* may be similarly applied in FIGS, 2, 2*b,* and 2*c*. The mixed suspension from the second hydraulic mixer is passed by means of the pump 13 to the vertical separator second stage 9. The accepted stock of the vertical separator second stage is, in turn, fed via the line 103 to the mixing tube 5.

Lastly, the stock suspension is delivered from the deaeration tank 14 via the line 110 by means of the headbox pump 10 to the vertical separator first stage 8. The accepted stock of the vertical separator first stage is fed via the line 100 to the distributor of the headbox 1. The deaeration tank 14 has a suction line 108 that deaerates the stock suspension therein.

According to the variant of FIG. 2, the feeds into the tube 5 for the additional suspensions include, in order along the main flow, as feed 101 for recirculation from a headbox 1, a feed 103 for accepted stock from a vertical separator second stage 9, followed by a feed 109 for recirculation from a first cleaner stage 106, followed by a feed 107 for accepted stock from a second cleaner stage 7 (these two combined in the recited order in the deaeration tank 14, from which a feed 104 extends to the tube 5), followed by a feed 105 for fresh stock. In this manner, addition of the recirculation from the headbox 1 is eliminated, avoiding possible pressure fluctuations and pulsations in the stable section which could be transferred by the recirculation from the headbox 1.

With this embodiment, circulation of the backwater is significantly reduced, and a more rapid adaptation at the time of a type changeover is enabled. Accordingly, the amount of defective production is significantly reduced at the time of the type changeover, and fewer quality losses result.

The first suspension includes a suspension of a backwater of the paper machine, and an entire backwater volume stream flows through the mixing tube 5. In this case, the backwater volume stream is reduced by a backwater substream sufficient, according to the dilution water principle, for weight basis control on the headbox 1 of the paper machine. The dilution water principle as applied in a headbox is well known to one of skill in the art, and a description thereof is found in U.S. Pat. No. 5,707,495 to Heinzmann et al., the disclosure of which is expressly incorporated by reference herein in its entirety.

Figure 2A:
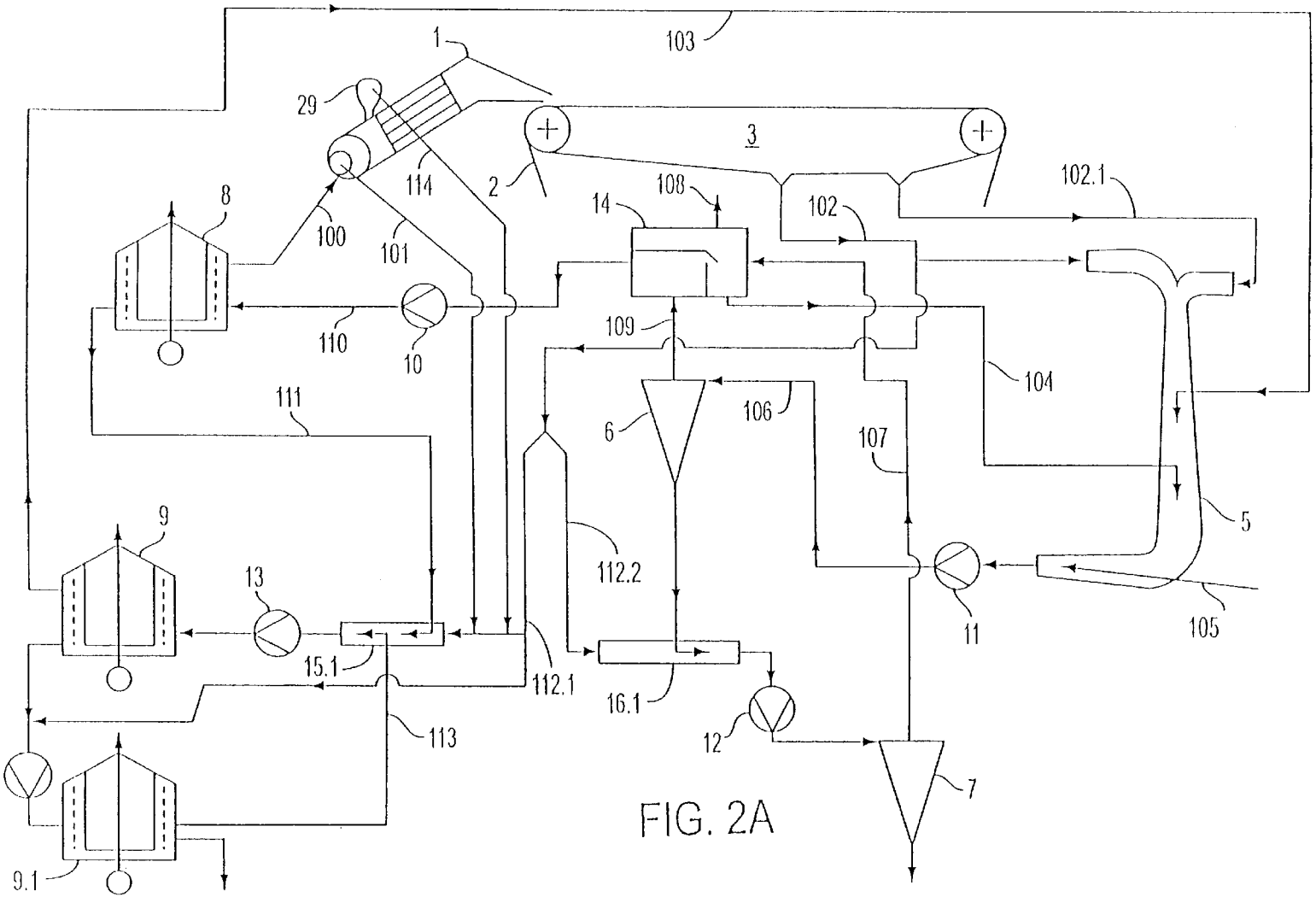
FIG. 2*a* shows a variant of FIG. 2, with piping of the recirculation from the headbox to the vertical separator second stage.

A first variant of the suspension piping of the stable section of the paper machine, according to the embodiment of the invention of FIG. 2, is depicted in FIG. 2*a*. In FIG. 2*a,* the recirculation from the headbox 1 is not passed into the mixing tube 5, but is passed via the line 101 into the pipe 112.1 directly upstream from the second hydraulic mixer 15.1. In addition, the headbox 1 includes a steamer 29, a return flow of which is also introduced via the return line 114 into the pipe 112.1 immediately upstream from the second hydraulic mixer 15.1. The remaining suspension piping and elements of the mixing device correspond to those described with reference to FIG. 2 and depicted therein.

That is, if the recirculation from the distributor of the headbox 1 is not passed into the mixing device 5, the recirculation line 101 from a distributor of the headbox 1 may be passed to the vertical separator second stage 9 (via the second hydraulic mixer 15.1). Moreover, the return flow line 114 from a steamer 29 of the headbox 1 may be passed to the vertical separator second stage 9 (also via the second hydraulic mixer 15.1).

According to the variant of FIG. 2*a,* the feeds into the tube 5 for the additional suspensions include, in order along the main flow, a feed 103 for accepted stock from a vertical separator second stage 9, followed by a feed 109 for recirculation from a first cleaner stage 106, followed by a feed 107 for accepted stock from a second cleaner stage 7 (these two combined in the recited order in the deaeration tank 14, from which a feed 104 extends to the tube 5), followed by a feed 105 for fresh stock. In this manner, addition of the recirculation from the headbox 1 is eliminated, avoiding possible pressure fluctuations and pulsations in the stable section which could be transferred by the recirculation from the headbox 1.

An advantageous effect of this first variant of the suspension piping is that possible pressure fluctuations and pulsations that are passed through the headbox 1 or that develop in the headbox 1 can be directed to a noncritical region of the stable section and can be compensated in the noncritical region. At the same time, the pulsation-sensitive regions of the stable section, e.g., including the mixing tube 5 and the feed lines 106, 109, 110, and 100, are protected from pressure fluctuations and pulsations.

Figure 2B:
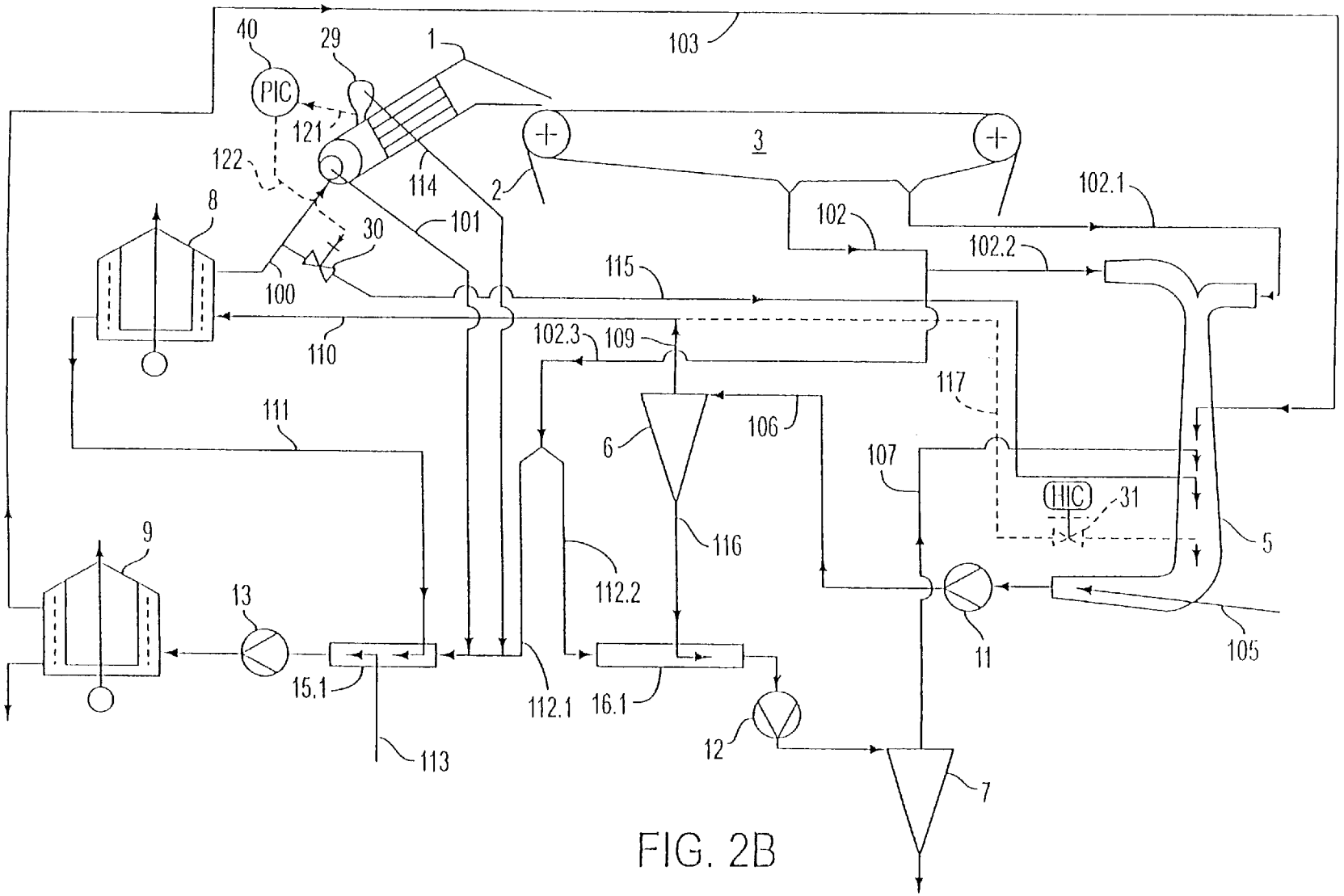
FIG. 2*b* shows a second variation of FIG. 2, without a deaeration tank and with excess control in the feed line to the headbox.

FIG. 2*b* depicts a second variant of the embodiment of FIG. 2 according to the invention of the suspension piping in the stable section of a paper machine. The variant depicted in FIG. 2*b* is essentially similar to that of FIG. 2, except that the deaeration tank 14 is omitted.

In this second variant, from the drainage devices 3 of the backwater section, as with FIG. 2, a portion of the first backwater fraction is discharged via the line 102 and passed to the mixing tube 5, while another portion of the first backwater fraction is fed (via lines 102.3, 112.1, and 112.2) to two hydraulic mixers 15.1 and 16.1. The first backwater fraction is introduced into the mixing tube 5 as the first fraction since it contains the smallest proportion of solid content. The second backwater fraction discharged via line 102.1, which has a somewhat higher concentration (e.g., solid content), is fed to the mixing tube 5 from the other side of the mixing tube 5 and downstream from the addition of the first backwater fraction. After the mixing of the first and second backwater fractions in the mixing tube 5, the accepted stock of the vertical separator second stage 9, which again has a somewhat higher concentration, is introduced via the line 103. An overflow of the second cleaner stage 7 is then introduced via the line 107, followed by the addition of a control return flow from a stock suspension addition to the headbox 1 via a pressure relief line 115.

Finally, at the end of the mixing tube 5, fresh stock is injected via the line 105 into the output region of the mixing tube 5, and is mixed with the other stock suspensions. The entire stock suspension taken from the mixing tube 5 is then fed via a pump 112 to the first cleaner stage 6. The accepted stock of the first cleaner stage 6 travels via the lines 109 and 110 into the vertical separator first stage 8, and the accepted stock of the vertical separator first stage 8 is fed via the line 100 to the headbox 1.

A branch provided in the line 100 leads to pressure relief line 115 back to the mixing tube 5. The pressure relief line 115 is valve-controlled via a valve 30. The control of the valve 30 is performed according to a pressure measurement on the headbox 1. In FIG. 2*b,* the pressure measurement is taken via measurement lines 121 and 122, and a control system (PIC—Pressure Indicated Control) 40 controls the valve 30. The control of the valve 30 is performed such that in the case of excess pressure in the headbox 1, the valve 30 in the line 115 is opened, and pressure relief of the stock addition to the headbox 1 is achieved by return flow via the line 115. The necessary pressure sensor for the measurement of the pressure in the headbox 1 may be disposed in the intake region of the stock suspension, in the region of the steamer 29, or in the region of a turbulence insert in the headbox 1.

In FIG. 2*b,* the headbox includes the steamer 29, with a return flow line 114 extending to the line 112.1, upstream of the second hydraulic mixer 15.1, as described with reference to FIG. 2*a*. However, it should be noted that the steamer 29, as well as the return flow line 114, may be omitted with appropriate design and control of the pressure relief line 115.

The second portion of the first backwater fraction, which is discharged via the line 102, is again subdivided, as with the embodiments in FIGS. 2 and 2*a,* into the lines 112.1 and 112.2. The line 112.1 leads to the second hydraulic mixer 15.1 as previously described with reference to FIG. 2*a*. Any return flow from the headbox steamer 29 in line 114 is fed into line 112.1 upstream from the second hydraulic mixer 15.1. Recirculation from the headbox 1 is also fed into line 112.1 via the line 101. The mixture of these three stock suspensions (or, e.g., two stock suspensions if no return flow from the steamer 29 is present) is added to the second hydraulic mixer 15.1. In this manner, the coarse fraction of the vertical separator first stage 8, via the line 111, as well as, e.g., accepted stock from a vertical separator third stage 9.1 (as shown in FIG. 2*a*), via the line 113, are mixed in the second hydraulic mixer 15.1. A pump 13 at the output of the second hydraulic mixer 15.1 delivers the stock suspension to the vertical separator second stage 9. The accepted stock of the vertical separator second stage 9 is again added to the mixing tube 5 via the line 103.

Parallel to the second hydraulic mixer 15.1, backwater of the first fraction is also piped, via line 112.2, to the first hydraulic mixer 16.1. The second fraction from the first cleaner stage 6 is fed in to the first hydraulic mixer 16.1 via the line 116 and is mixed therein with the backwater of the first fraction. The resultant suspension mixture is delivered from the hydraulic mixing tube 16.1, via a second cleaner pump 12, to the second cleaner stage 7. The accepted stock from the second cleaner stage 7 is added via the line 107 to the mixing tube 5. The remaining suspension piping and elements of the mixing device correspond to those described with reference to FIG. 2 and 2*a* and depicted therein.

That is, in the second variant of FIG. 2*b,* the feeds into the tube 5 for the additional suspensions include, in order along the main flow, a feed 103 for accepted stock from a vertical separator second stage 9, followed by a feed 107 for accepted stock of a second cleaner stage 7, followed by a feed 115 for excess from a stock suspension feed 100 to a headbox 1, followed by a feed 105 for fresh stock.

In a further, optional modification of this second variant, downstream from the line 109, a branch of the line 109 from the first cleaner stage 6 leads into a line 117. The line 117 takes excess accepted stock from the first cleaner stage 6 to the mixing tube 5, and a controlled valve 31 (HIC—Hand Indicated Control) controls the line 117. This modification is depicted with dotted lines in FIG. 2*b*.

An advantage of this second variant of the embodiment of FIG. 2, i.e., employing a stable section without a deacration tank, is that a smaller recirculation volume is necessary for the entire system.

Figure 2C:
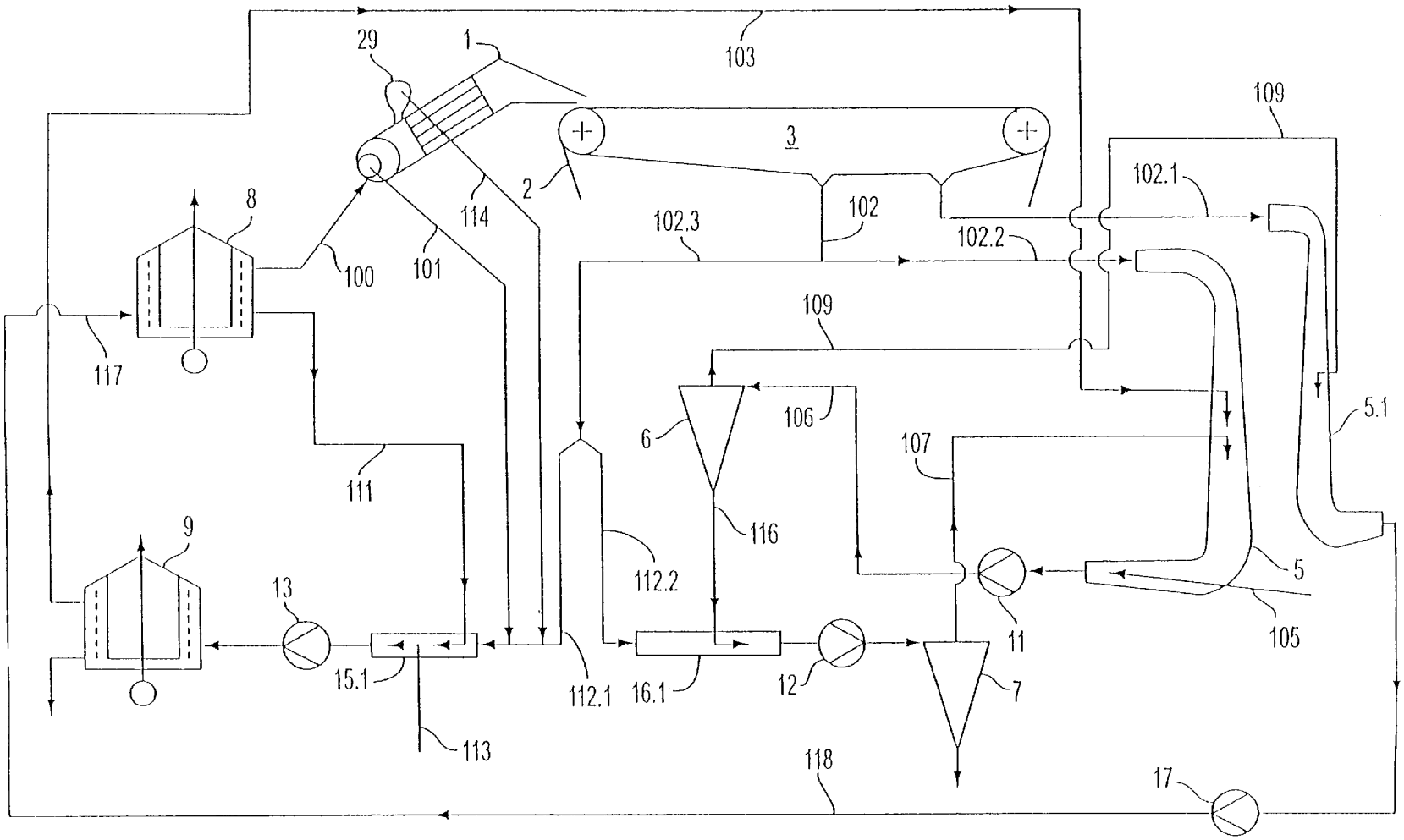
FIG. 2*c* shows a third variation of FIG. 2, without a deaeration tank and with separate subsequent dilution.

FIG. 2*c* depicts a third variant of the embodiment stock suspension piping with a mixing tube in the stable section of a paper machine, again, without a deaeration tank as in FIG. 2*b*. However, as described below, two mixing tubes 5 and 5.1 are employed.

In FIG. 2*c,* similarly to FIG. 2*b,* the first backwater fraction of the drainage device 3 of the backwater section is discharged and then divided via the lines 102.2 and 102.3. A portion of the first backwater fraction is fed as a main flow, via the line 102.2, to a first mixing tube 5. The accepted stock from the vertical separator second stage 9 is introduced into the first mixing tube 5 downstream of the main flow via the line 103. Moreover, as described below, overflow from the second cleaner stage 7 enters the first mixing tube 5 via the line 107 downstream of line 103. Lastly in the first mixing tube 5, accepted stock, having a concentration (e.g., solid content) higher than that of the suspension mixture into which it is introduced, is mixed via a feed line 105 arranged near to the output of the first mixing tube 5. Accordingly, the accepted stock introduced via the feed line 105 is mixed with the suspension mixture in the mixing tube 5. The entire suspension mixture leaving the first mixing tube 5 is fed via a first cleaner pump 11 to the first cleaner stage 6.

The second part of the first backwater fraction, which is fed via the lines 102 and 102.3 to a branch and thereby to lines 112.1 and 112.2, arrives via line 112.2 to the first hydraulic mixer 16.1 and via line 112.1 to the second hydraulic mixer 15.1. Moreover, as with the variants of FIGS. 2*a* and 2*b,* to the line 112.1 upstream of the second hydraulic mixer 15.1, overflow from the steamer 29 of the headbox 1 is fed via the line 114, and the recirculation from the headbox is fed via the line 101. The coarse con of the vertical separator first stage 8 is added to the second hydraulic mixer 15.1 via the line 111. As previously noted, the accepted stock of a vertical separator third stage 9.1 (as shown in FIG. 2*a*) can be fed into the second hydraulic mixer 15.1 via the line 113. A pump 13 downstream from the second hydraulic mixer 15.1 adds the resulting mixture to the stock suspension of the vertical separator second stage 9. The accepted stock of the vertical separator second stage 9 arrives at the first mixing tube 5 via the line 103.

The remaining stock from the first cleaner stage 6 is added, via the line 116, to the first hydraulic mixer 16.1, as is a portion of the first backwater fraction via the line 112.2. From the first hydraulic mixer 16.1, the mixture is delivered to the second cleaner stage 7 by the second cleaner pump 12. As noted above, overflow from the second cleaner stage 7 is added via the line 107 to the mixing tube 5, where the second cleaner stage 7 overflow is added to the main flow stream including the accepted stock from the vertical separator second stage 9.

In contrast to the variant depicted in FIG. 2*b,* the second backwater fraction of the drainage device 3 is fed via the line 102.1 to a second mixing tube 5.1, into which the overflow of the first cleaner stage 6 is then blended via the line 109. This entire suspension is delivered by another pump 17 from the second mixing tube 5.1, via a line 118, to the vertical separator first stage 8. A feed line 100 leads from the vertical separator first stage 8 to the headbox 1 and delivers the fresh stock suspension to the headbox 1. The remaining suspension piping and elements of the mixing device correspond to those described with reference to FIG. 2 and depicted therein.

That is, in the third variant of FIG. 2*c,* the "mixing tube 5" includes a first mixing tube 5 provided for a first backwater fraction of a backwater stream of the paper machine, and a second mixing tube 5.1 for a second backwater fraction of a backwater stream of the paper machine. The feeds (or injections) into the first mixing tube 5 for the additional suspensions include, in order along the main flow, a feed 103 for accepted stock from a vertical separator second stage 9, followed by a feed 107 for accepted stock of a second cleaner stage 7, followed by a feed 105 for fresh stock. The feed into the second mixing tube 5.1 for the additional suspensions include a feed 109 for accepted stock from a first cleaner stage 6.

In the third variant of the embodiment of a mixing device as depicted in FIG. 2, employing a stable section without a deaeration tank, the second mixing tube 5.1 serves for subsequent dilution of the second backwater fraction, and the recirculation volume of the entire system is reduced. Moreover, an improvement of the stability of the operation is achieved, without the risk of back flows complications, which result in inadmissibly high stock concentrations and can negatively affect the longitudinal profile of the paper produced. Moreover, the cleaner capacity can also be reduced, whereby a further reduction of the circulating volume is established.

Figure 3:
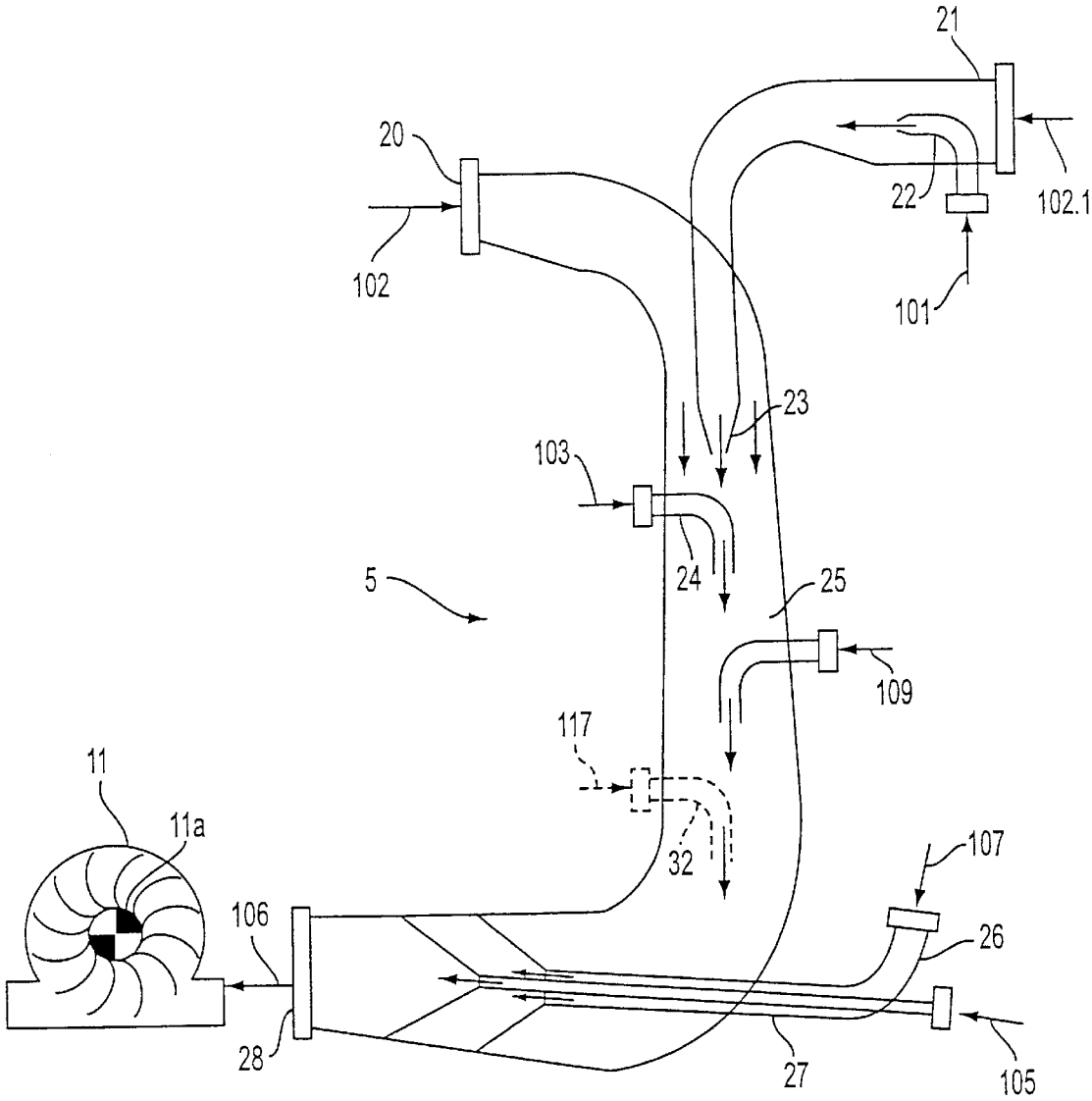
FIG. 3 shows a mixing tube according to an embodiment of the invention.

FIG. 3 depicts, in detail, an example of a mixing tube 5 according to the invention, with corresponding injections. It should be noted that the mixing tube 5 from FIG. 3 is depicted by way of example, and is not identical to the mixing tubes 5, 5.1 of the preceding drawings, since the individual examples shown differ in the concentration relationships of the suspension added. In this regard, the mixing tube of FIG. 3 employs injections as shown in various of the previous drawings, and the overall structure of each mixing tube 5, 5.1 and injections thereof of the embodiments of the invention are preferably structured in a manner corresponding to the structure depicted in FIG. 3 and as described below.

As shown in FIG. 3, in the mixing tube 5, the first fraction of the backwater from the wet section is added via the line 102 to the mixing tube 5 through an intake port 20. On the opposite side of the mixing tube 5, the second fraction of the backwater is fed to a port 21 via the line 102.1. The recirculation of the stock suspension from the distribution pipe of the headbox 1 is added to the second fraction of the backwater via a line 101 and a nozzle 22. The mixture of the second fraction of the backwater with the recirculation from the headbox 1 are then injection together through a nozzle 23 into the first fraction of the backwater in the mixing tube 5 and thoroughly mixed.

Downstream from the nozzle 23, another nozzle 24 is depicted in which the accepted stock of the vertical separator second stage 9 is added to the mixing tube 5 via the line 103, and injected into the suspension stream. The recirculation of the first cleaner stage 6 is then added via the line 109 and a nozzle 25. The mixing tube 5 is then bent by substantially 90 degrees. At the end of the bend, two concentrically arranged nozzles 26, 27 are installed. The first nozzle 26 adds the accepted stock from the second cleaner stage 7 via the line 107. The second nozzle 27, which is arranged concentrically inside the nozzle 26, injects fresh stock into the main flow of the mixing tube 5 via the line 105. Volume flow increases downstream along the main flow, and the volume flow of the last injection added via nozzle 27 is smaller than the volume flow of the next to last injection added via nozzle 26 (the volume flow of the next to last injection added via nozzle 26 is greater than the volume flow of the last injection added via nozzle 27). At the end of the mixing tube 5, the finished stock suspension leaves the mixing tube 5 through the outlet port 28, and is delivered via the line 106 to the first cleaner pump 11 and the first cleaner stage 6.

Optionally, inside diameters of the nozzles 22, 23, 24, 25, 26, 27, and 32 and an inside diameter of the mixing tube 5 in the region of the respective nozzles are arranged such that a flow rate vD in each respective nozzle and a flow rate vU of the main flow in a region surrounding the respective nozzle are in a ratio vD/vU from 3 to 15. Maintaining this relationship particularly favors a thorough mixing of the individual liquids.

The mixing tube 5 is a hydraulically closed system excepting the intake ports 20, 21, and the outlet port 28 for the blended suspension. That is, the mixing tube 5 is closed relative to its surroundings, or constitutes a closed hydraulic system having no pressure equalization capability with its surroundings. Moreover, the entire hydraulic system of FIGS. 2–2*c* between the paper machine and the stock stream of the headbox can have a closed construction, and there are no free surfaces of the suspension exposed to surrounding areas.

Optionally, internal diameters of the mixing device (tube) 5 is designed such that a flow rate of the main flow is maintained at a substantially constant level despite added liquid in the additional suspensions blended therein, and such that the flow rate of the main flow in the mixing device 5 increases only in an end region of the mixing device.

Advantageously, each of the plurality of feeds includes an injection site that injects an additional suspension having a solid content equal to or greater than a previous injection site of a previous feed along the downstream direction of the main flow. In other words, the concentration or the solid content of the suspensions added should increase continuously or remain the same in the direction of flow. The concentration differences at the individual mixing points are minimized, which ensures high mixing efficiency and low fluctuations in concentration. In this case, each of the injection sites may include an outlet port or nozzle, with each outlet port pointing in a direction of the main flow. In this manner, the flow directions of the main flow and the added suspension(s) have essentially the same orientation.

Accordingly, a mixing device 5 for the blending of additional suspensions into a first suspension in the stable section of a paper machine includes a tube 5, and an intake 20 and/or 21 in the tube for the first suspension, the first suspension having a negligible solid content. A plurality of feeds 101, 103, 109, 117, 105, 107 into the tube 5 are provided for the additional suspensions to be blended with the first suspension into a blended suspension with a new solid content, the additional suspensions having higher solid content than the first suspension. An outlet 28 in the tube 5 is provided for the blended suspension, the outlet being disposed downstream from a bend in the tube. A pump 11 is connected to the tube 5 downstream from the outlet 28, wherein an impeller axis 11*a* of the pump 11 is perpendicular to a plane containing portions of the tube 5 both upstream and downstream of the bend. That is, the mixing device 5 is preferably arranged perpendicularly and has at its lower end a bend with a connection to the downstream pump (e.g., the cleaner pump 11). The plane of the bend and the perpendicular part of the mixing tube 5 is perpendicular to the axis 11*a* of rotation of the downstream pump 11. This ensures uniform inflow, in particular with double-suction pumps.

As noted above, the flow rate in the mixing tube 5 is optionally greater than 0.2 m/s, and further optionally, greater than 0.45 m/s (e.g., the dimensions of the mixing device 5 are arranged to maintain these numerical flow rates).

In an optional modification, as depicted by dotted lines in FIG. 3, an additional nozzle 32 adds accepted stock of the first cleaner stage 6 via a line 117 downstream from the injection through the nozzle 25.

Figure 4:
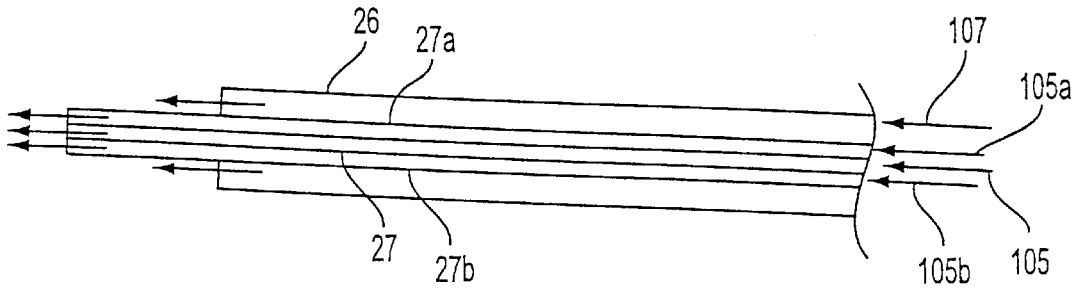
FIG. 4 shows a modification of a feed for injecting fresh stock into the mixing tube of FIG. 3.

Fresh stock is conventionally formed from several components or ingredients, and in the mixing tube 5 of FIG. 3, the fresh stock is premixed from the several components or ingredients and injected into the main flow of the mixing tube 5 via the line 105 and the nozzle 27. FIG. 4 is a detailed view of a modification of the feed 105 and nozzle 27 as employed in the mixing tube 5 of FIG. 3. In this further modification, as depicted in FIG. 4, different components or ingredients of fresh stock are not premixed, but are added to the mixing tube via separate feeds 105, 105*a*, 105*b* at the same location as feed 103 of FIG. 3. That is, in the modification depicted in FIG. 4, each different component or ingredient is provided with a line and nozzle. More specifically, a first component or ingredient of the fresh stock is injected into the main flow of the tube 5 via line 105 and nozzle 27, a second component or ingredient of the fresh stock is injected into the main flow of the tube 5 via feed 105*a* and nozzle 27*a*, and a third component or ingredient of the fresh stock is injected into the main flow of the tube 5 via feed 105*b* and nozzle 27*b*. Accordingly, as depicted in FIG. 4, the various components or ingredients of fresh stock are injected into the main flow of the mixing tube via individual feeds 105, 105*a*, 105*b*, each with an individual nozzle 27, 27*a*, 27*b* for each of the feeds (lines) and for each component or ingredient. More than three ingredients components may be so injected.

In the modification of the injection of fresh stock as depicted in FIG. 4, a plurality of ingredients of fresh stock are injected via a plurality of corresponding feeds 105, 105*a*, 105*b* (etc.) in substantially the same location along said main flow.

In each variation, the process includes feeding a backwater suspension from a wet section of the paper machine as a main flow into a closed vertical mixing tube 5, then injecting accepted stock (e.g., via feed 103) from a vertical separator system (e.g., 8; 9) concentrically into the main flow to form a blended suspension in the mixing tube 5, the injection of the accepted stock having a higher solid content than the backwater suspension and a higher flow rate than the main flow. Fresh stock is then injected concentrically (e.g., via feed 105) into the blended suspension in the mixing tube 5, the injection of the fresh stock having a higher solid content than the blended suspension and a higher flow rate than the blended suspension, then the blended suspension is pumped from the mixing tube 5. A flow rate in the mixing tube may be maintained at a substantially constant level upstream and downstream of the injections.

Accordingly, the process for the mixing of suspension of different natures and/or compositions in the stable section of a paper or cardboard machine provides an improvement of quality and a reduction of production losses at the time of a type changeover. By means of the process according to the invention, larger backwater tanks are avoided, thereby reducing the amount of water in circulation in the paper machine, and, thus, at the time of the type changeover in the paper machine, a more rapid change in the composition of the stock suspensions is possible. Based on this more rapid change, the quality losses, and therefore also the production losses, are reduced. The "backwater" indicates the total circulating backwater with which, along with the fresh stock, the concentration of the stock suspension required in the headbox is obtained, as depicted in FIG. 1. The cycles in the stable section are described in detail in the literature.

As shown in FIGS. 2, 2*a*–2*c*, and 3 a mixing device includes a closed vertical mixing tube 5 having a bend at a lower end thereof. An intake 20 and/or 21 is provided at a top of the tube for a backwater suspension from a wet section of the paper machine, the backwater suspension forming a main flow. A first concentric nozzle (e.g., nozzle 24 connected to feed 103) injects accepted stock, having a higher solid content than the backwater suspension, from a vertical separator system (e.g., 8; 9) into the mixing tube 5 to form a blended suspension. The first concentric nozzle 24 is concentric to the mixing tube 5 and upstream of the bend, and injects the accepted stock at a higher flow rate than the main flow. A second concentric nozzle (e.g., nozzle 27 connected to feed 105) injects fresh stock having a higher solid content than the blended suspension into the mixing tube 5. The second concentric nozzle 27 is concentric to the mixing tube 5 and downstream of the bend, and injects the fresh stock at a higher flow rate than the blended suspension. An outlet 28 in the tube 5 is disposed downstream from the bend and from the second concentric nozzle 27. In this case, as shown in FIG. 3, a diameter of the mixing tube 5 may increase in the direction of the main flow to maintain a flow rate in the mixing tube 5 at a substantially constant level upstream and downstream of both of the first concentric nozzle 24 and the second concentric nozzle 27.

The mixing device as described enables an effective and economical blending of suspensions with a higher solid content into a first suspension with little or no solid content in the stable section of a paper or cardboard machine, while omitting an expensive backwater tank. At the same time, the mixing device reduces the amount of water circulated as well as quality losses and production loss at the time of a type changeover.

Although the present invention has been described herein with reference to particular means, materials and embodiments, it is understood that the words which have been used herein are words of description and illustration, rather than words of limitation. The present invention is not intended to be limited to the particulars disclosed herein; rather, the present invention extends to all functionally equivalent and/or insubstantially different structures, such as are within the scope of the appended claims. Changes may be made, within the purview of the appended claims, as presently stated and as amended, without departing from the scope and spirit of the present invention in its aspects.

What is claimed is:

1. A mixing device for blending of additional suspensions into a first suspension in a stable section of a paper machine, comprising:

a tube;

an intake in said tube for the first suspension, said first suspension having a negligible a plurality of feeds into said tube for the additional suspensions to be blended with said first suspension into a blended suspension with a new solid content, said additional suspensions having higher solid content than the first suspension;

an outlet in said tube for the blended suspension, said outlet being disposed downstream from a bend in said tube; and a pump connected to said tube downstream from said outlet, wherein an impeller axis of the pump is perpendicular to a plane containing portions of said tube both upstream and downstream of said bend.

2. The mixing device according to claim 1 wherein each of said plurality of feeds includes an injection site that injects an additional suspension having a solid content equal to or greater than a previous injection site of a previous feed along a downstream direction of a main flow.

3. The mixing device according to claim 2 each of said injection sites comprising an outlet port, each outlet port pointing in a direction of the main flow.

4. The mixing device according to claim 1, wherein an internal diameter of the mixing device is designed such that a flow rate of a main flow is maintained at a substantially constant level despite added liquid in said additional suspensions blended therein, and such that said flow rate of the main flow in the mixing device increases only in an end region of the mixing device.

5. The mixing device according to claim 1, wherein each of said plurality of feeds includes an injection site, and wherein each injection site terminates centrally in the mixing device.

6. The mixing device according to claim 1, further comprising a recirculation line from a distributor of a headbox passed via a line to said tube.

7. The mixing device according to claim 1, further comprising a return flow line from a steamer of a headbox passed via a line to a vertical separator second stage.

8. The mixing device according to claim 1, wherein said plurality of feeds into said tube for the additional suspensions comprise, in order along a main flow:

a feed for recirculation from a headbox, followed by a feed for accepted stock from a vertical separator second stage, followed by a feed for recirculation of a first cleaner stage, followed by a feed for accepted stock from a second cleaner stage, followed by a feed for fresh stock.

9. The mixing device according to claim 1, wherein said plurality of feeds into said tube for the additional suspensions comprise, in order along a main flow:

a feed for accepted stock from a vertical separator second stage, followed by a feed for recirculation from a first cleaner stage, followed by a feed for accepted stock from a second cleaner stage, followed by a feed for fresh stock.

10. The mixing device according to claim 1, wherein said plurality of feeds into said tube for the additional suspensions comprise, in order along a main flow:

a feed for accepted stock from a vertical separator second stage, followed by a feed for accepted stock of a second cleaner stage, followed by a feed for excess from a stock suspension feed to a headbox, followed by a feed for fresh stock.

11. The mixing device according to according to claim 1, wherein said tube comprises:

a first mixing tube provided for a first backwater fraction of a backwater stream of the paper machine; and a second mixing tube for a second backwater fraction of a backwater stream of the paper machine, and wherein said plurality of feeds into said first mixing tube for the additional suspensions comprise, in order along a main flow:

a feed for accepted stock from a vertical separator second stage, followed by a feed for accepted stock of a second cleaner stage, followed by a feed for fresh stock, and said plurality of feeds into said second mixing tube for the additional suspensions comprise a feed for accepted stock from a first cleaner stage.

12. The mixing device according to claim 1, wherein each of said plurality of feeds includes an injection site surrounded by a main flow, and inside diameters of the injection sites and an inside diameter of the mixing device in the region of the injection site are arranged such that a flow rate vD in each injection site and a flow rate vU of the main flow in a region surrounding the injection site are in a ratio vD/vU from 3 to 15.

13. The mixing device according to claim 1, wherein the mixing device is a hydraulically closed system excepting the intake and the outlet port for the blended suspension.

14. A mixing device for blending of additional suspensions into a first suspension in a stable section of a paper machine, comprising:

a tube;

an intake in said tube for the first suspension, said first suspension having a negligible solid content and forming a main flow;

a plurality of feeds into said tube for the additional suspensions to be blended with said first suspension into a blended suspension with a new solid content, said additional suspensions having a higher solid content than the first suspension;

an outlet in said tube for the blended suspension, said outlet being disposed downstream from a bend in said tube, wherein each feed of said plurality of feeds injects an additional suspension having a solid content equal to or greater than a previous feed along the downstream direction of the main flow.

15. A mixing device for blending of additional suspensions into a backwater suspension in a stable section of a paper machine, comprising:

a closed vertical mixing tube having a bend at a lower end thereof;

an intake at a top of said mixing tube for a backwater suspension from a wet section of the paper machine, said backwater suspension forming a main flow;

a first concentric nozzle that injects accepted stock, having a higher solid content than said backwater suspension, from a vertical separator system into said mixing tube to form a blended suspension, said first concentric nozzle being concentric to said mixing tube and upstream of said bend, and injecting said accepted stock at a higher flow rate than said main flow;

a second concentric nozzle that injects fresh stock having a higher solid content than said blended suspension into said mixing tube, said second concentric nozzle being concentric to said mixing tube and downstream of said bend, and injecting said fresh stock at a higher flow rate than said blended suspension; and an outlet in said tube, said outlet being disposed downstream from said bend and from said second concentric nozzle.

16. The mixing device according to claim 15, wherein a diameter of said mixing tube increases in the direction of the main flow to maintain a flow rate in said mixing tube at a substantially constant level upstream and downstream of both of said first concentric nozzle and said second concentric nozzle.

17. A mixing device for blending of additional suspensions into a first suspension in a stable section of a paper machine, comprising:

a tube comprising a bend;

an intake in said tube for the first suspension, said first suspension having a first solid content;

a plurality of feed lines connected to said tube, each feed line supplying an additional suspension to be blended with said first suspension into a blended suspension with a new solid content, at least one of the additional suspensions having higher solid content than the first suspension;

a feed line supplying suspension from a wet section of the paper machine to the intake of said tube;

each of the plurality of feed lines being coupled to a nozzle which has a nozzle outlet concentrically arranged in said tube;

each nozzle supplying additional suspension upstream from the bend in said tube;

an outlet in said tube for the blended suspension, said outlet being disposed downstream from the bend in said tube; and a pump connected to said tube downstream from said outlet, wherein each of said plurality of feeds injects an additional suspension having a solid content equal to or greater than a previous feed along the downstream direction of a main flow.

* * * * *